US006934981B2

(12) United States Patent
Waldman et al.

(10) Patent No.: US 6,934,981 B2
(45) Date of Patent: Aug. 30, 2005

(54) COMBINATION BASSINET, CHANGING TABLE AND BEDSIDE SLEEPER

(75) Inventors: Kenneth C. Waldman, Reading, PA (US); Jerome Drobinski, Reading, PA (US)

(73) Assignee: Simplicity, Inc., Reading, PA (US)

( * ) Notice: Subject to any disclaimer, the term of this patent is extended or adjusted under 35 U.S.C. 154(b) by 0 days.

(21) Appl. No.: 10/766,364

(22) Filed: Jan. 28, 2004

(65) Prior Publication Data

US 2004/0181873 A1 Sep. 23, 2004

Related U.S. Application Data

(63) Continuation of application No. 10/103,580, filed on Mar. 21, 2002, now Pat. No. 6,704,949.

(51) Int. Cl.[7] ..... A47D 7/02; A47D 7/04; A47D 11/00

(52) U.S. Cl. ..... 5/95; 5/93.2; 5/98.1; 5/11

(58) Field of Search ..... 5/93.1, 93.2, 95, 5/98.1, 99.1, 101, 102, 655, 105–107, 424, 426, 11, 97

(56) References Cited

U.S. PATENT DOCUMENTS

| | | | | |
|---|---|---|---|---|
| 122,737 A | * | 1/1872 | Riter | 5/97 |
| 130,554 A | | 8/1872 | Wiggers | 5/105 |
| 141,918 A | | 8/1873 | Carpenter | 5/106 |
| 287,721 A | | 10/1883 | Ranney | 5/106 |
| 413,107 A | | 10/1889 | Stoy | 5/95 |
| 472,647 A | | 4/1892 | Walker | 5/95 |
| 484,975 A | | 10/1892 | Perry | 5/11 X |
| 548,005 A | | 10/1895 | Miller, Jr. | 5/11 X |
| 620,069 A | | 2/1899 | Cobb | 5/95 |
| 732,618 A | | 6/1903 | Collier | 5/11 X |
| 744,993 A | | 11/1903 | Barta | 5/105 |
| 918,789 A | | 4/1909 | Spear | 5/95 |
| 962,767 A | | 6/1910 | Lawyer | 5/95 |
| 1,138,451 A | | 5/1915 | Bugele | 5/95 |
| 1,200,830 A | | 10/1916 | Goss | 5/95 |
| 1,267,244 A | | 5/1918 | McMillan | 5/95 |
| 1,283,169 A | | 10/1918 | Hasson | 5/99.1 |
| 1,468,682 A | | 9/1923 | Wallace | 280/11 |
| 1,546,617 A | | 7/1925 | Caldwell et al. | 280/43 |
| 1,812,699 A | | 6/1931 | Hursch | 5/102 |
| 1,920,580 A | | 8/1933 | McGlauthen | 5/99.1 |
| 2,106,927 A | | 2/1938 | Kinnear | 5/106 |
| 2,291,233 A | | 7/1942 | Karlik | 5/93.1 |
| 2,452,838 A | | 11/1948 | Corne | 5/3 |
| 2,461,609 A | | 2/1949 | Light | 280/31 |
| 2,475,775 A | | 7/1949 | Boren | 5/93.1 |

(Continued)

FOREIGN PATENT DOCUMENTS

| | | | |
|---|---|---|---|
| GB | 5334 | 2/1911 | 5/95 |
| GB | 1578716 | 11/1980 | 5/99.1 |

*Primary Examiner*—Robert G. Santos
(74) *Attorney, Agent, or Firm*—Volpe and Koenig, PC

(57) ABSTRACT

A combination bassinet, bedside sleeper and changing table apparatus including a supporting frame having a rocking feature convertible through adjustable locking casters for easy rolling. A fabric member comprised of sidewalls and a skirt is draped over the frame. The apparatus may be placed against one side of an adult bed for easy access by a parent. The bedside sleeper is secured to the parents' bed with safety straps. One sidewall may be lowered to facilitate access to an infant by removal of a removably mounted sidewall/skirt supporting rod. The apparatus is adjustable in height to align the bedside sleeper with the parents' bed and when used as a changing table to accommodate for differences in the height of the parent. The bassinet is provided with a removable, adjustable hood for shielding light from the baby's eyes. The apparatus comprises a skeletal structure covered with a soft, aesthetically pleasuring and yet sturdy cloth which is easily removable and washable and includes two convenient storage areas.

20 Claims, 10 Drawing Sheets

U.S. PATENT DOCUMENTS 2,541,327 A 2/1951 Billinghurst ..... 280/7.1
2,553,087 A 5/1951 Hanson ..... 5/93.1
2,574,559 A 11/1951 Graf et al. ..... 5/11
2,632,186 A 3/1953 Berk et al. ..... 5/99.1
2,681,659 A * 6/1954 Hrinsin ..... 256/25
2,688,997 A * 9/1954 Miller ..... 297/129
2,691,176 A 10/1954 Saldana ..... 5/93.1
2,716,439 A 9/1955 Feist ..... 280/7.1
2,927,331 A * 3/1960 Ruiz ..... 5/97
2,936,464 A 5/1960 Miller et al. ..... 5/109
3,335,433 A 8/1967 Stopek ..... 5/105
3,344,442 A * 10/1967 Andrews et al. ..... 5/97
3,427,666 A 2/1969 Saxe ..... 5/2.1
3,670,344 A 6/1972 Boudreau ..... 5/11
3,735,430 A 5/1973 Platz ..... 5/118
3,896,513 A 7/1975 Boucher et al. ..... 5/99.1
3,944,241 A 3/1976 Epelbaum ..... 280/30
4,021,867 A 5/1977 Maxwell, Jr. ..... 5/106
4,043,349 A * 8/1977 Gays et al. ..... 135/137
4,265,461 A 5/1981 Okubo ..... 280/1.13
4,538,309 A 9/1985 Gunter ..... 5/99.1
4,715,075 A 12/1987 Shamie ..... 5/93.1
4,722,537 A 2/1988 Chau-Pin ..... 280/1.13
4,790,340 A * 12/1988 Mahoney ..... 135/90
4,825,484 A * 5/1989 Riegel ..... 5/97
4,891,852 A * 1/1990 Lopez, Jr. ..... 5/105
4,945,584 A * 8/1990 LaMantia ..... 5/97
4,967,432 A 11/1990 Kujawski et al. ..... 5/98.1
5,013,086 A 5/1991 Benzur ..... 297/272.1
5,148,561 A 9/1992 Tharalson et al. ..... 5/95
5,161,484 A 11/1992 Duane ..... 5/95 X
5,163,191 A 11/1992 Chan ..... 5/98.1
5,172,435 A 12/1992 Griffin et al. ..... 5/95
5,172,451 A 12/1992 Chiu ..... 16/35 R
5,203,581 A 4/1993 Jankowski ..... 280/87.051
5,293,655 A 3/1994 VanWinkle et al. ..... 5/95
5,339,470 A 8/1994 Shamie ..... 5/98.1
5,349,709 A 9/1994 Cheng ..... 5/93.1
5,373,708 A 12/1994 Dumoulin, Jr. ..... 62/457.7
5,375,294 A 12/1994 Garrett ..... 16/34
5,430,899 A 7/1995 Chisholm ..... 5/95
5,485,655 A 1/1996 Wang ..... 16/371
D366,978 S * 2/1996 Mariol ..... D6/491
D367,788 S * 3/1996 Lawhorn ..... D6/491
D370,149 S * 5/1996 Stratton ..... D6/610
5,517,707 A * 5/1996 LaMantia ..... 5/97
5,553,336 A 9/1996 Mariol ..... 5/93.1
5,581,827 A 12/1996 Fong et al. ..... 5/98.1
5,604,941 A 2/1997 Rom an ..... 5/95
5,636,853 A 6/1997 Huang ..... 280/30
D383,625 S * 9/1997 Dillner ..... D6/491
D390,730 S * 2/1998 Gerhart et al. ..... D6/491
5,778,465 A 7/1998 Myers ..... 5/99.1
5,822,817 A 10/1998 Carew et al. ..... 5/732
5,845,349 A 12/1998 Tharalson et al. ..... 5/99.1
D404,216 S * 1/1999 Gerhart ..... D6/391
5,862,548 A * 1/1999 Gerhart ..... 5/93.1
5,867,850 A 2/1999 Mariol ..... 5/93.2
5,884,348 A 3/1999 Onishi et al. ..... 5/93.2
5,938,218 A 8/1999 Chuang ..... 280/87.051
5,956,786 A 9/1999 Huang ..... 5/105
5,963,998 A 10/1999 Carew et al. ..... 5/655
6,026,524 A 2/2000 Barger ..... 5/93.1
6,058,528 A 5/2000 Yang ..... 5/93.1
6,079,063 A 6/2000 Cheng ..... 5/98.1
6,112,347 A 9/2000 Tharalson et al. ..... 5/95
6,123,091 A 9/2000 Flynn et al. ..... 135/96
6,131,218 A 10/2000 Wang ..... 5/93.1
6,148,456 A 11/2000 Tharalson et al. ..... 5/99.1
6,158,067 A 12/2000 Cheng ..... 5/106
D437,024 S * 1/2001 Glover et al. ..... D21/837
6,173,462 B1 1/2001 Huang et al. ..... 5/655
6,192,535 B1 2/2001 Warner, Jr. et al. ..... 5/93.1
6,202,228 B1 3/2001 Cox ..... 5/95
D444,840 S * 7/2001 Glover et al. ..... D21/834
6,341,394 B1 1/2002 Wang ..... 5/105
6,418,575 B1 7/2002 Cheng ..... 5/93.1
6,425,150 B1 * 7/2002 Cheng ..... 5/97
6,430,762 B1 8/2002 Cheng ..... 5/93.2
6,434,767 B1 8/2002 Welsh, Jr. ..... 5/93.2
6,467,107 B1 * 10/2002 Glover et al. ..... 5/99.1
6,470,515 B1 10/2002 Hsia ..... 5/99.1
6,470,516 B2 10/2002 Lopez, Jr. ..... 5/105
6,513,869 B1 2/2003 Wu ..... 297/130
6,516,823 B1 * 2/2003 Glover et al. ..... 135/94
6,526,608 B1 3/2003 Hsia ..... 5/99.1
6,539,563 B1 4/2003 Hsia ..... 5/93.2
6,543,070 B2 4/2003 Longenecker et al. ..... 5/93.1
6,546,575 B2 4/2003 DeAngelo ..... 5/95
6,550,082 B2 4/2003 Tharalson et al. ..... 5/95
6,550,083 B1 * 4/2003 LaMantia ..... 5/97
6,571,408 B1 6/2003 Wang ..... 5/99.1
6,578,211 B2 6/2003 Tharalson et al. ..... 5/93.2
6,588,033 B1 7/2003 Welsh, Jr. et al. ..... 5/99.1
6,704,949 B2 * 3/2004 Waldman et al. ..... 5/93.1
2002/0078498 A1 6/2002 Cheng ..... 5/93.1
2002/0083524 A1 7/2002 Tharalson et al. ..... 5/95
2002/0092094 A1 7/2002 Welsh, Jr. ..... 5/95
2002/0120985 A1 * 9/2002 Lopez ..... 5/108
2002/0152550 A1 10/2002 Tharalson et al. ..... 5/95
2002/0166169 A1 11/2002 Longenecker et al. ..... 5/93.1
2003/0126681 A1 7/2003 Tharalson et al. ..... 5/93.2
2003/0177574 A1 * 9/2003 Waldman ..... 5/93.1
2003/0196264 A1 * 10/2003 Tharalson et al. ..... 5/95
2004/0099301 A1 * 5/2004 Zhang et al. ..... 135/135
2004/0181873 A1 * 9/2004 Waldman et al. ..... 5/95
2005/0005353 A1 * 1/2005 Waldman et al. ..... 5/101
2005/0034232 A1 2/2005 Martin ..... 5/95

* cited by examiner

COMBINATION BASSINET, CHANGING TABLE AND BEDSIDE SLEEPER

This application is a continuation of U.S. patent application Ser. No. 10/103,580, filed Mar. 21, 2002, now U.S. Pat. No. 6,704,949 which is incorporated by reference as if fully set forth.

BACKGROUND

The present invention relates to baby cribs and more particularly to a novel three-in-one crib arrangement capable of functioning as a bassinet, changing table and bedside sleeper.

SUMMARY

It is not uncommon for families having an infant to provide a separate bassinet, changing table and bedside sleeper. Obviously all of these units occupy space and can make an infant's room quite confining, especially in instances where the infant's room is small. Also, the costs of these units can be prohibitive to many potential customers.

The present invention is characterized by comprising an apparatus in which all the capabilities of bassinet, changing table and bedside sleeper are integrated into one unitary apparatus which is capable of being changed over quite simply and quite readily.

The apparatus of the present invention comprises a lightweight and yet sturdy and stable skeletal structure which is designed to function as a rocking bassinet when the casters provided thereon are drawn in from the rolling position. The housings for the casters extend well beyond the curved rocking members to limit the degree of rocking and thereby provide added stability for the structure. The casters, when lowered, allow the structure to be easily rolled and are also capable of being locked in the "down" position when it is desired to prevent the structure from rolling.

Swingably mounted hoops (i.e. gussets) are provided for adjustably supporting a hood to cover the baby's eyes from light, which swingable hoops are capable of being lowered to gain total access to the surface supporting the infant.

A section of the top support of the skeletal structure is removable to gain access to the interior of the bedside sleeper when positioned adjacent to parent's bed or when used as a changing table. Nevertheless, a safety bar is provided to act as a barrier to prevent the child from easily rolling out of the bedside sleeper. The sleeper is secured to the parents' bed by safety straps which are placed beneath the mattress and preferably between the mattress and the bedspread to assure safe, secure attachment of the bedside sleeper to the parents' bed.

The skeletal structure is covered with a lightweight, durable, washable fabric which is designed to provide an aesthetic exterior appearance. The cover includes a side storage bag and larger underside storage area to provide adequate room for diapers, baby clothes and other items such as powders, salves, ointments, creams and the like typically advantageously provided in close proximity to a changing table.

The skeletal supporting structure is adjustable preferably to at least four different heights to align the structure to the parents' bed when used as bedside sleeper and also when used as either a changing table or bassinet, to accommodate the height of the person attending to the infant.

The entire structure is extremely light in weight and easy to use and yet quite rugged and stable and is easily and quickly assembled and disassembled for compact storage, transportation and use.

It is therefore one object of the present invention to provide a novel apparatus capable of functioning as a bassinet, changing table and bedside sleeper requiring very minor adjustment to convert to any one of the above functions.

Still another object of the present invention is to provide a novel apparatus capable of functioning as a bassinet, changing table and bedside sleeper and which is comprised of a skeletal superstructure which is lightweight and yet strong, rugged and stable and which is covered by a lightweight, sturdy, washable, aesthetically pleasing fabric which, in addition to accommodating the baby, is provided with accessible storage areas respectively located to one side and the underside of the apparatus.

The above as well as other objects of the present invention will become apparent when reading the accompanying description and drawings in which:

BRIEF DESCRIPTION OF THE DRAWING(S)

FIGS. 1*a* and 1*b* are perspective views respectively showing the skeletal structure of the present invention with the casters in the supporting and concealed position.

FIGS. 1*c* and 1*d* respectively show side and end views of the structure of FIG. 1*a*.

FIG. 1*e* draws a more detailed view of one of the wheel assemblies of FIGS. 1*a* and 1*b*.

FIG. 1*f* is a detailed view of one of the brackets of FIG. 1*a*.

FIG. 1*g* is an exploded, detailed view of the removable rod of FIG. 1*a* and the cooperating brackets.

Figure 3:
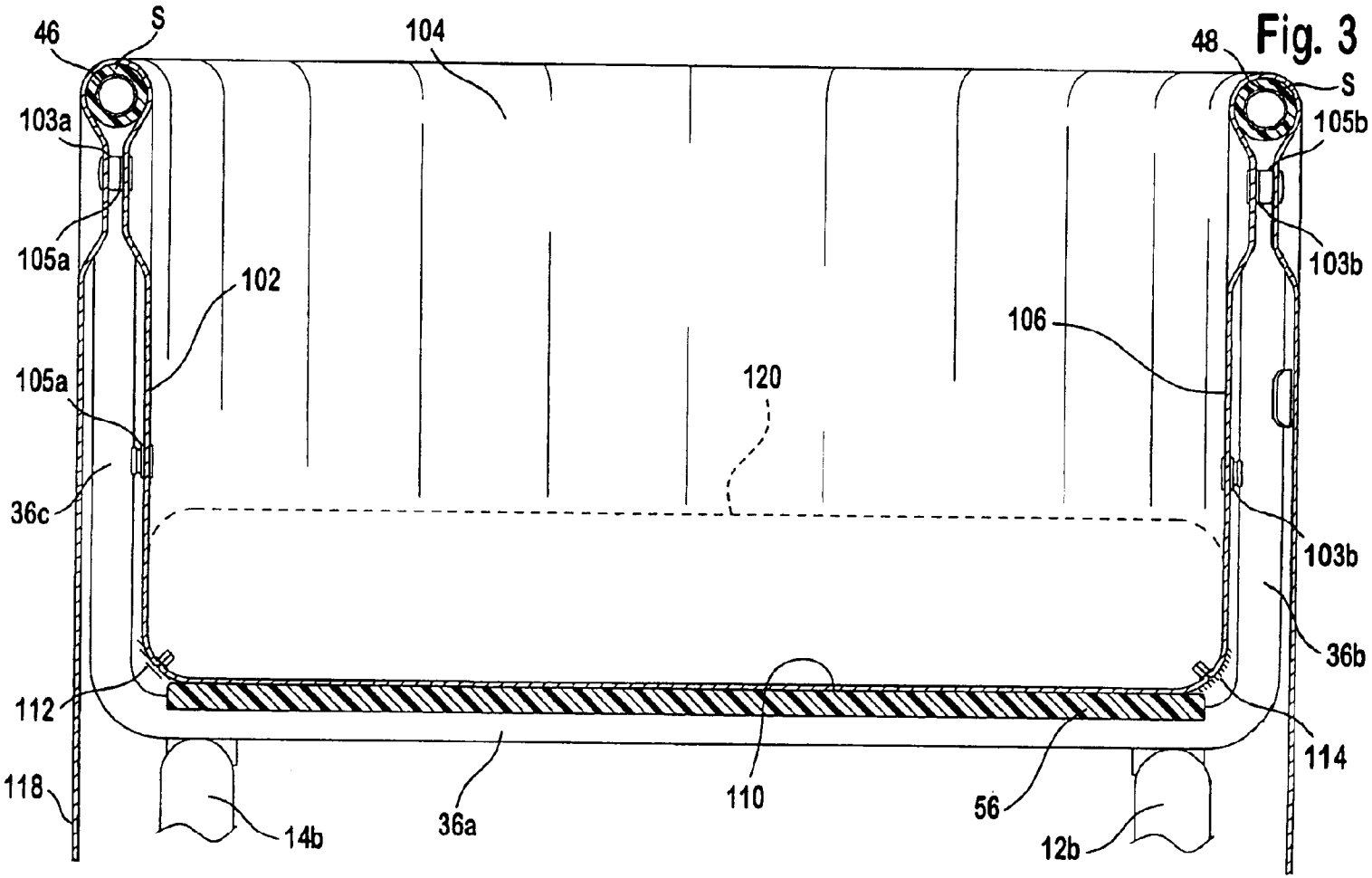
FIG. 3 shows a sectional view of the cover structure for covering the skeletal structure of FIG. 1*a*.
Figure 3A:
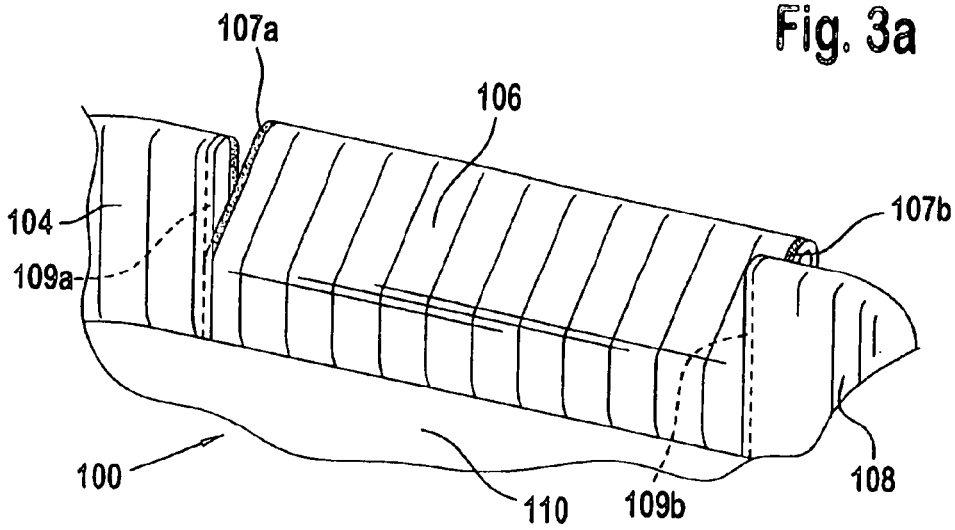

FIG. 3*a* is a perspective view of a portion of the cover structure showing the manner in which the cover structure converts from a bassinet to a co-sleeper.

Figure 3B:
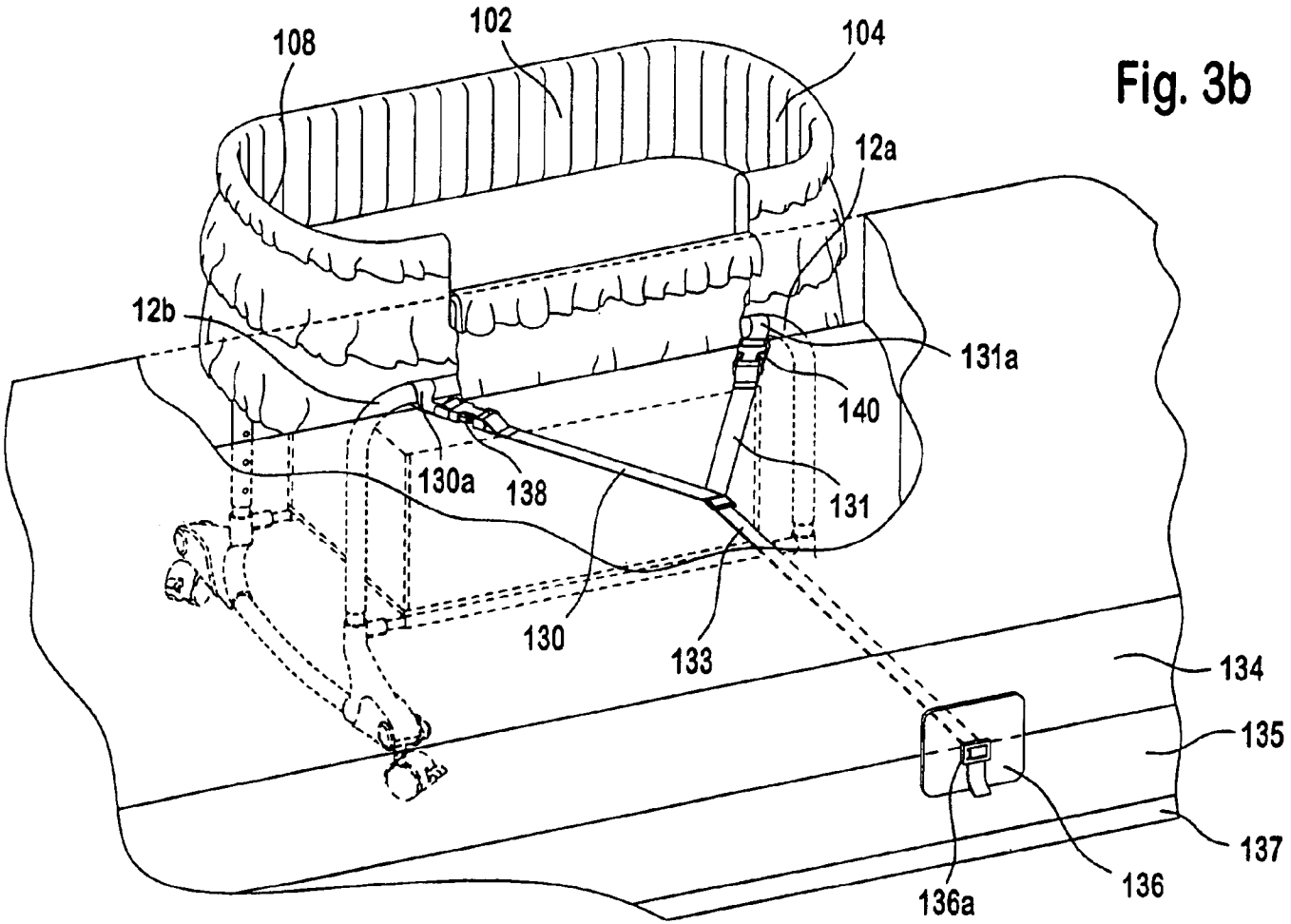

FIG. 3*b* is an elevational view showing the manner in which the co-sleeper is held against a parent's bed.

Figure 1A:
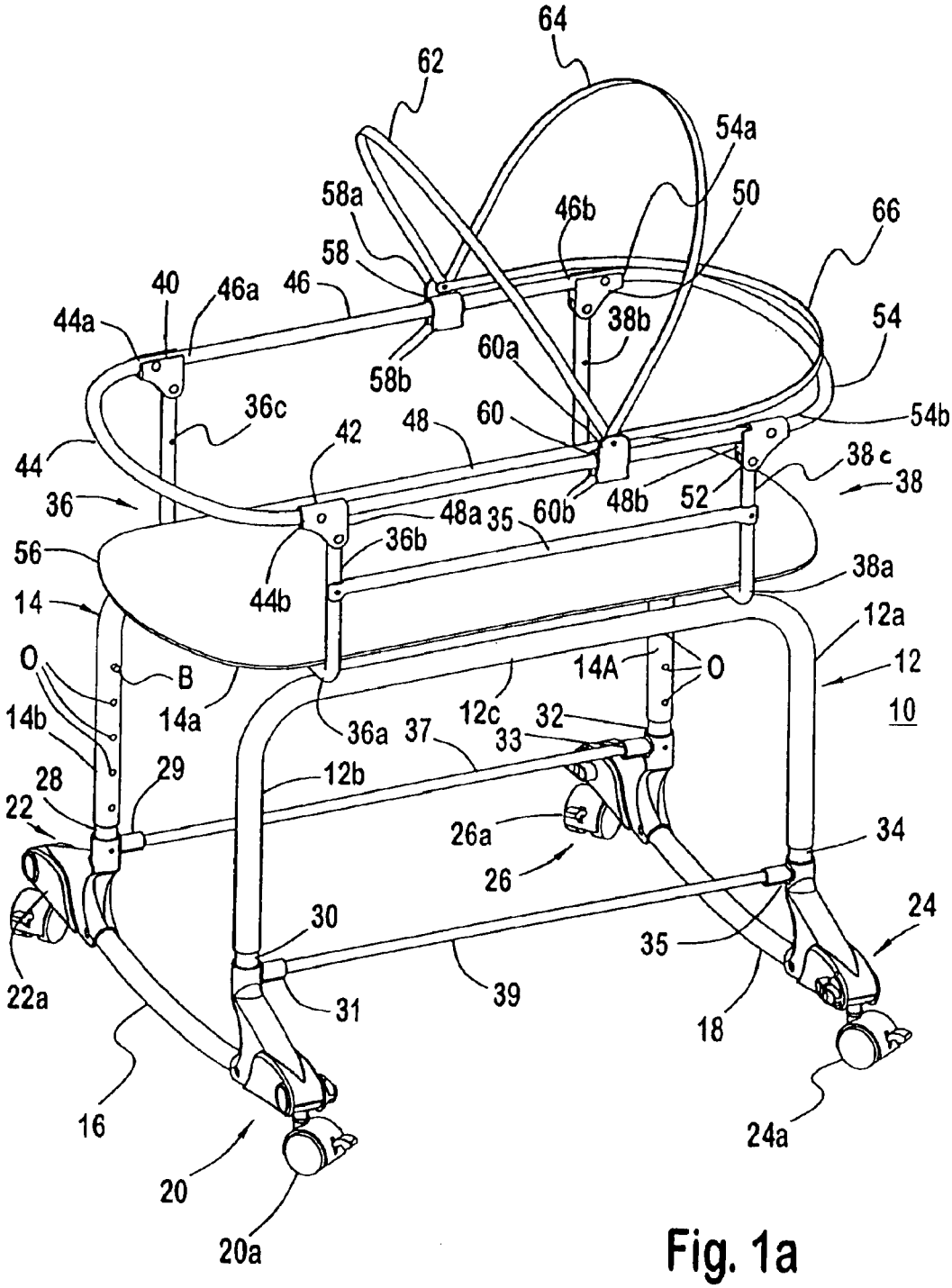
Figure 1B:
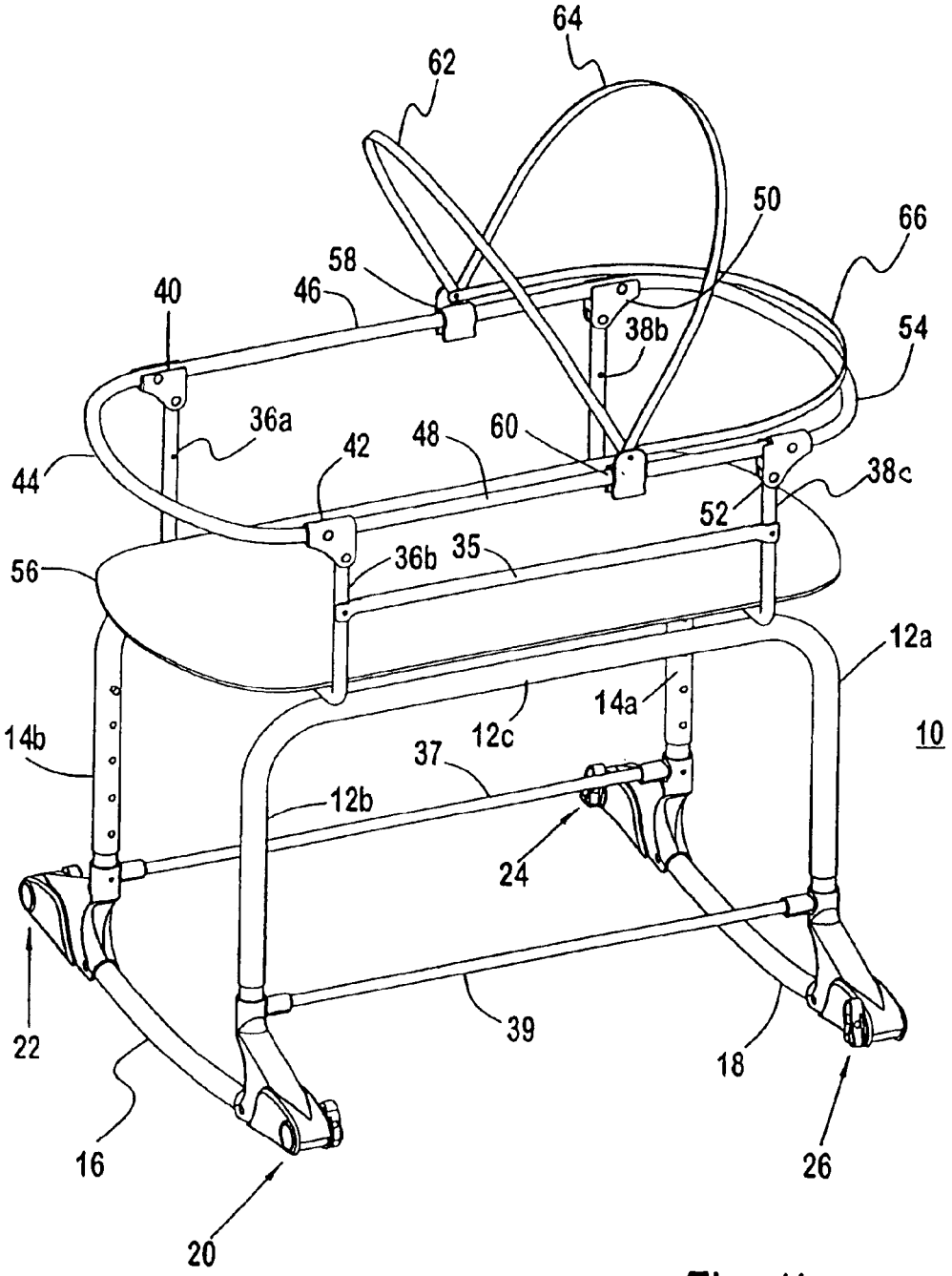
Figure 1C:
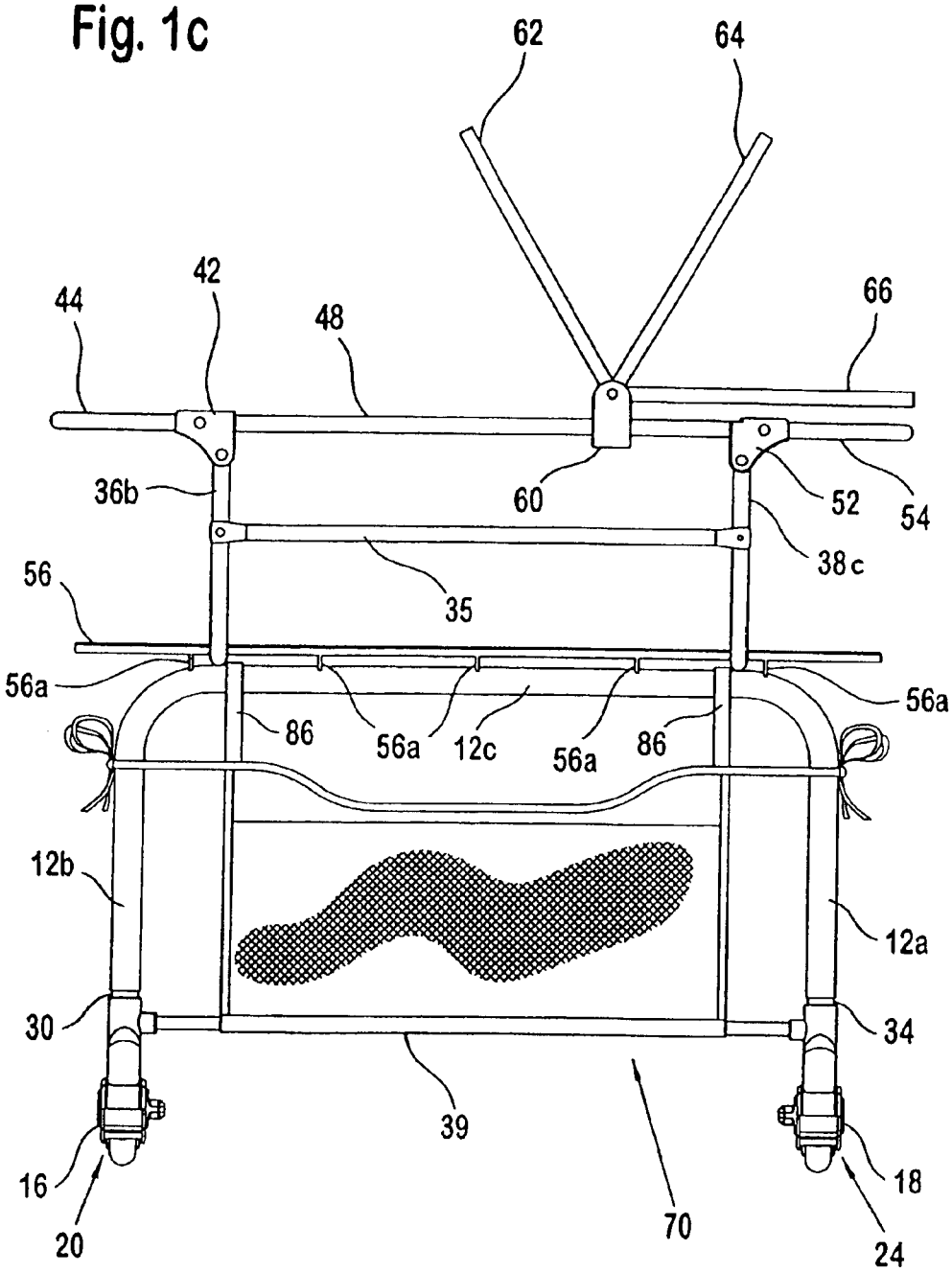
Figure 1D:
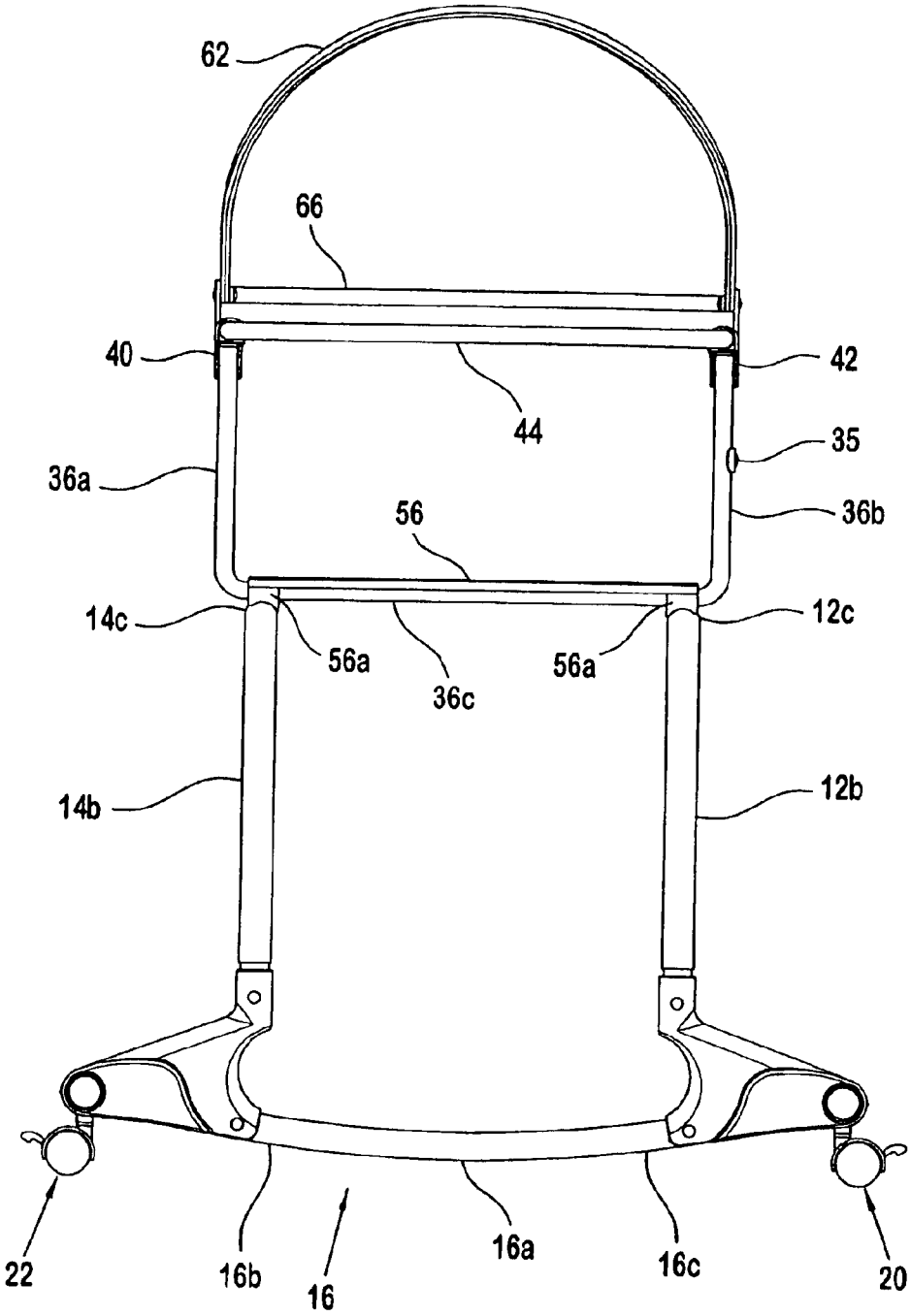
Figure 4:
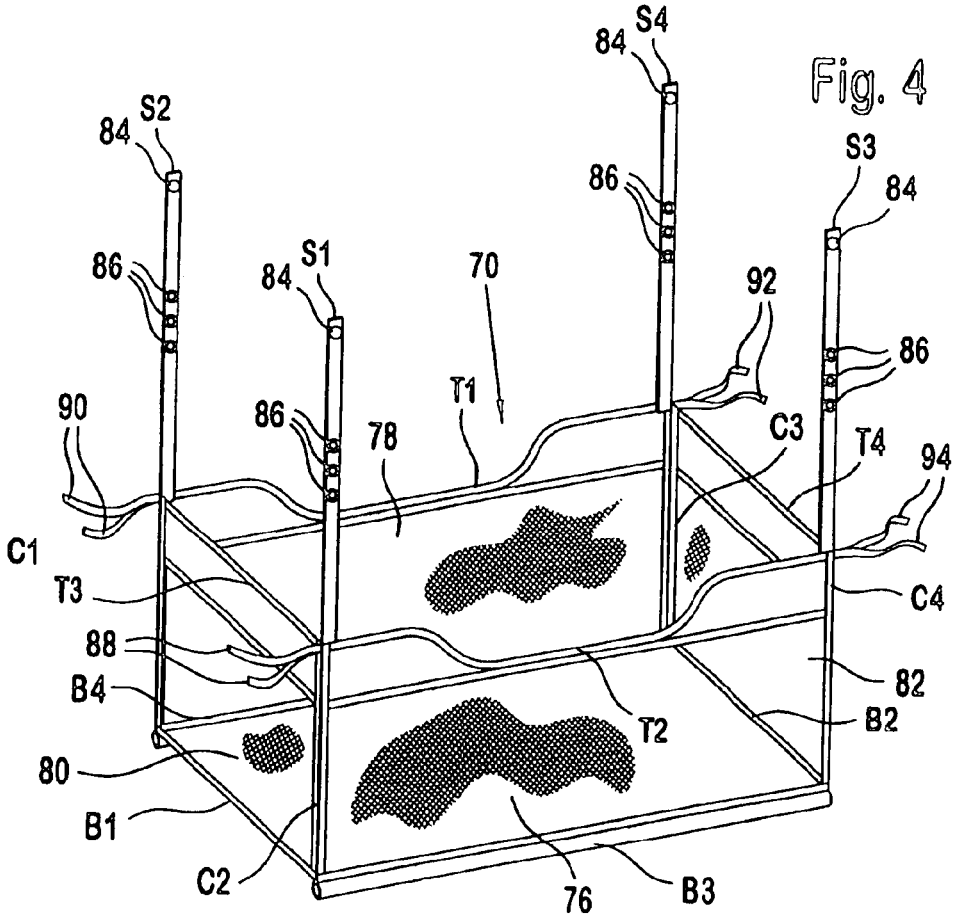

FIG. 4 is a perspective view of the storage basket shown in FIGS. 1*c* and 1*d*.

DETAILED DESCRIPTION OF THE PREFERRED EMBODIMENTS

FIGS. 1*a*–1*d* and 3*d* show the skeletal structure 10 embodying the principles of the present invention and comprising a pair of inverted, substantially U-shaped, hollow, tubular members 12 and 14 respectively having depending legs 12*a*–12*b*, 14*a*–14*b* extending downwardly, and a yoke portion 12*c*, 14*c*.

A pair of hollow curved tubular members 16, 18 are each joined to retractable wheel assemblies 20–22 and 24–26 respectively mounted at opposite ends thereof.

The retractable wheel assemblies, as shown in FIG. 1*d* are each provided with a recess for receiving an end 16*b*, 16*c* of a curved member 16. The tubular member 18 is secured to the wheel assemblies 24, 26 in like fashion to that shown in FIG. 1*d*.

Figure 1E:
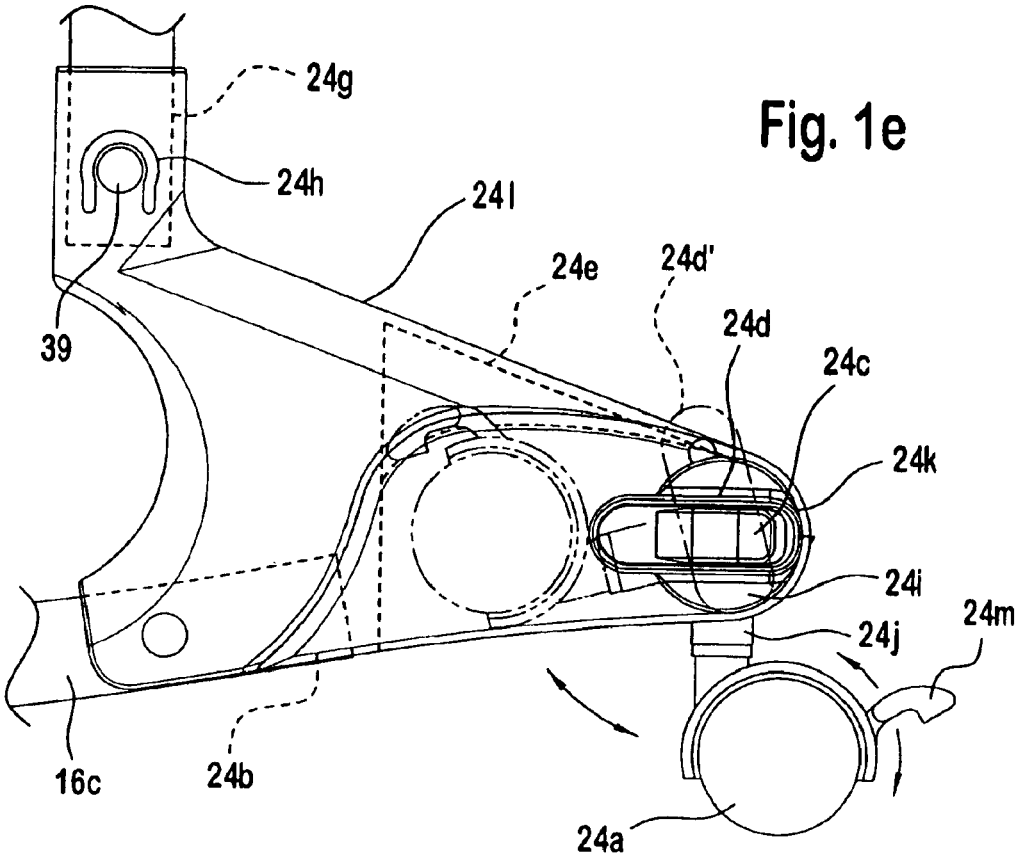

FIG. 1*e* is a detailed view of one wheel assembly 24 showing the recess 24*b* for receiving an end of tubular member 18. The retractable wheels shown in FIG. 1*a* are in the "down" position where the skeletal structure is capable of being easily rolled along a surface. The wheels are moved upwardly to a retracted position by operating a toggle button 24*c* and an operating lever 24*d* surrounding toggle switch 24*c*. Toggle button 24*c* pivots about a vertical axis A and is normally urged into a locked position. Pushing button 24*c* at the right-hand end unlocks the castor assembly 24*a*, allowing lever 24*d* to be rotated in order to rotate caster 24*a* clockwise about the disc-shaped portion 24*i* at the upper end of the arm 24*j* holding caster 24*a*, disc-shaped portion being swingably mounted within an opening 24*b* in housing 24*l*. Lowering the caster 24*a* is performed by operating the toggle button in a similar manner, however, the lever 24*d* is rotated counter-clockwise to lower the caster 24*a*. When pressure on the right-hand end of toggle button 24*c* is released, the toggle button returns to the locked condition. Moving the casters 20*a*, 22*a* 24*a*, 26*a* into their recesses enables the skeletal structure to be rocked by the curved convex central portions 16*a*, 18*a* of tubular members 16, 18. Even though the wheels 20*a*, 22*a*, 24*a* and 26*a* are retracted, the underside of their housings such as 16*b*, 16*c*, can engage the surface supporting the skeletal structure, preventing the structure, when it is rocked, from toppling over (see FIG. 1*d*). The wheel assemblies are provided with conventional locking members, such as the slide switch 24*f* (not shown in detail for purposes of simplicity), which, when moved in one direction, lock the wheels 22*a*–26*a* from rolling when they are in the "down" position. Sliding the switch 24*f* in the opposite direction unlocks the wheels allowing them to roll freely. The outwardly projecting housings for the wheels provide a wider "footprint" to greatly enhance the stability of the skeletal structure.

Wheel assemblies 20–26 are further provided with integral, upwardly directed, hollow tubular projections 20*g*–26*g* (see FIG. 1*e*) each adapted to receive the lower end of one of the elongated, hollow, tubular, upright members 28–30 and 32–34, which extend into the hollow projections 20*g*–26*g* of assemblies 20–26. The upper ends of tubular members 28–34 each telescope into a lower end of one of the legs 12*b*–14*b*, 12*a*–14*a*. The legs 12*b*–14*b*, 12*a*–14*a* are provided with an array of spaced openings, such as, for example, the openings O shown provided on legs 14*a*, 14*b*, for purposes of receiving a conventional spring loaded button B provided on an upper end of each tubular member which locks into one of the openings provided on each leg, enabling the tubular members 12 and 14 to be raised (or lowered) to a desired height. The legs of each tubular member 28–34 can be adjusted simply by pressing the buttons B inwardly so that they are cleared of the openings O and moving the members 12 and 14 relative to the members 28–30 and 32–34. As soon as the spring loaded button B aligns with an opening, the spring loaded button B will snap into the opening and lock the associated leg at a desired height. All of the buttons B for each of the remaining three legs operate in a similar manner.

Integral hollow projections 29–33 provided on assemblies 22, 20 receive a rod 37 which provides additional structural support. A similar rod 39 extends between similar integral, hollow projections 31–35 to provide similar structural support. Rods 39 and 37 are snap-filled into the projections and extend through sleeves B3, B4 in storage basket 70, shown in FIGS. 1*c*, 1*d* and 4. The basket 70 is formed of a light-weight, open weave, mesh fabric which enables the contents of the basket to be easily observed through the side panels 76, 78 and end panels 80, 82 The vertically aligned corners C1–C4 are each comprised of strips formed of a suitable, rugged, tight-weave, durable fabric to support the basket. Bottom end strips B1 and B2 are similar to strips C1–C4. Likewise top side strips T1, T2 and top end strips T3, T4 each serve to rigidify the basket to assist in retaining its rectangular, box-like shape. The elongated strips T1–T4, C1–C4 and B1–B4 are preferably formed of more rugged, tightly-woven, rugged, strips of material which are sewn to the mesh material to form a basket.

The basket 70 makes excellent use of the open region beneath board 56 supported by tubular members 36, 38. The basket 70 is suspended from the skeletal structure by means of four (4) elongated straps S1–S4 arranged in each of the four corners of the basket 70. The straps are each provided with a plurality of spaced, female snap members 84. One of the snaps 84 is snap-fitted with a cooperating male snap member 86 each male snap member being provided at opposite ends of yokes 12*c*, 14*c* (see FIG. 1*c*). The female snap member 84 which is snap-fitted to member 86 is chosen so as to keep the basket 70 upright and suitably taut.

Pairs of tie members 80, 90, 92 and 94 are provided at the upper corners of basket 70 and are tied about the upper portions of legs 12*a*–12*b*, 14*a*–14*b* to hold the basket taut in the horizontal direction.

The pair of upright, substantially U-shaped tubular members 36, 38 have yoke portions 36*a*, 38*a* resting upon the yoke portions 12*c*, 14*c* and preferably joined thereto, for example, by suitable fasteners, which also secure the board 56 thereto. Standoffs 56*a* maintain board 56 parallel to yokes 12*c* and 14*c*, see FIGS. 1*c* and 1*d*. Members 36 and 38 are arranged substantially at right angles to yokes 12*c* and 14*c*. Member 36 has upwardly directed arms 36*b*, 36*c* and member 38 has upwardly directed arms 38*b*, 38*c*. Brackets 40 and 42 join the free ends of 44*a*, 44*b* of the curved tubular member 44 and first ends 46*a*, 48*a* of straight tubular members 46 and 48 to the upright arms 36*a* and 36*b*. Similar brackets 50, 52 join the opposite ends 46*b*, 48*b* of tubular members 46 and 48 and the free ends 54*a*, 54*b* of curved tubular member 54 to the upright arms 38*b*, 38*c*. The tubular members 44 and 36*b* are pivotally mounted to bracket 42 to allow these members to fold into a compact arrangement when disassembled and stored. The brackets 40, 50 and 52 are similar in design and function.

Rigid board 56 is secured to the yoke portions 36*a*, 38*a* of tubular members 36 and 38 by the aforementioned suitable fasteners (not shown) and serves as the base of the bassinet/changing table/bedside sleeper and as a support for a mattress 120 (FIG. 3).

Figure 1F:
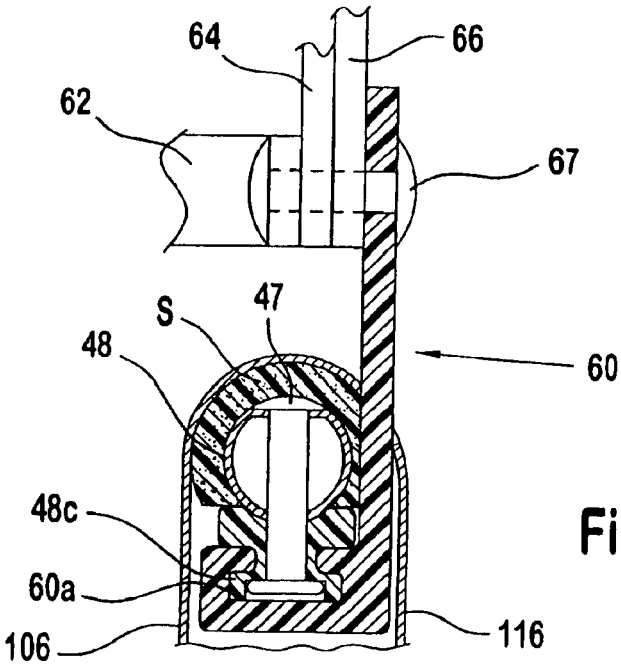

Brackets 58 and 60 are releasably, mounted to locking projections arranged on the underside of rods 46, 48, For example, FIG. 1*f* shows rod 48, having cooperating projection 48*c* secured to rod 48 by pin 49. Bracket 60 has a cooperating slot 60*a* which is slidably mounted upon projection 48*c*. The free ends of curved gusset members 62, 64 and 66 are pivotally mounted upon the brackets 58, 60 by pin 67. Gusset members 62, 64 and 66 serve as the means for supporting a hood H (see FIG. 2) to shield the infants' eyes from overhead light, as will be more fully described. The brackets 58, 60 which slidably mount to the rods 46, 48 as set forth above, may be removed by sliding the brackets 60 away from the projections, such as projection 48*c*, enabling the canopy H to be easily removed/replaced. The gussets 62–66 are swingably mounted to brackets 58–60 to enable hood H to be easily raised and lowered.

The tubular members 35, 44, 46 & 48 are preferably enclosed in elongated, resilient, foam-type, plastic sleeves, such as sleeve S, shown in FIG. 1*f*, to cushion these rods and reduce injury to an infant or other person engaging these rods.

Figure 2:
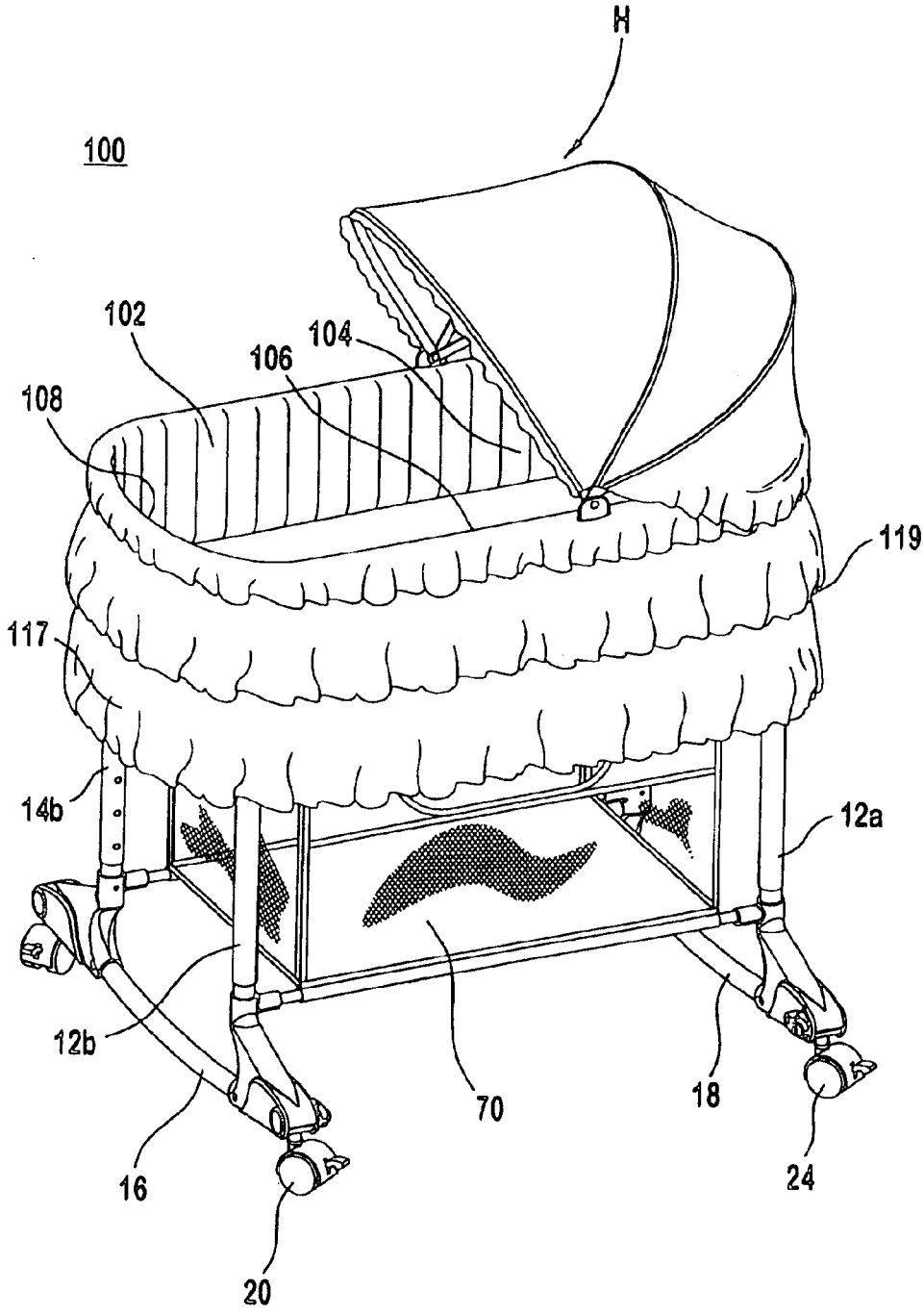
FIG. 2 is a perspective view showing the skeletal structure of FIG. 1 covered to form the 3-in-1 structure of the present invention.

FIG. 2 shows the skeletal structure 10 covered with a fabric member 100. Making reference to FIG. 3 as well as FIG. 2, the fabric member 100 is comprised of interior sidewalls, FIG. 2 showing two (2) straight sidewalls 102, 106 and two (2) curved sidewalls 104, 108. The straight sidewalls 102, 106, shown in the sectional view of FIG. 3, as well as curved sidewall 104, have their lower ends joined, preferably by being sewn, to a bottom sheet 110. The sewn portions joining sidewalls 102 and 106 to the bottom sheet are shown at 112 and 114. The two curved sidewalls 104 and 108 are joined in a like manner, being sewn to the outer perimeter of bottom sheet 110.

Bottom sheet 110 rests upon the upper surface of board 56. A mattress 120 (shown in dotted fashion), is placed upon bottom sheet 110.

The upper ends of straight sidewalls 102 and 106 respectively rest on rods 46 and 48 and a portion of their free ends are each sewn to an integral skirt portions 118, 116 which skirt portions hang downwardly preferably to a point below the board 56. The short sidewalls are likewise joined to skirt portions 117, 119 in a like manner, as by sewing.

The surfaces 102*a* and 106*a* of the sidewalls 102 and 106 are provided with male-type snap buttons 103*a*, 103*b*. The surfaces 118*a*, 116*a* are each provided with male-type snap buttons 105*a*, 105*b*. The buttons 105*a*, 105*b* are arranged to be snap-fitted with buttons 103*a*, 103*b*. It should be understood that a plurality of pairs of cooperating snap-buttons 103*a*, 103*b* and 105*a*, 105*b* are arranged at spaced intervals along the straight sidewalls 102, 106 (as well as curved sidewalls 104 and 108), all of which pairs are snap-fitted together to retain the cover member in place draped over the skeletal frame. If desired, cooperating loop-type and hook-type strips may be substituted for the buttons without any change in effectiveness.

The placement of the mattress 120 upon the bottom sheet 110 cooperates with the button pairs to retain the cover member 100 in place.

The sidewall 106 of cover member 110 is capable of being pulled away from the adjacent curved sidewalls 104, 108. As shown in FIG. 3*a*, which shows lower portions of the skirt removed to assist in an understanding of FIG. 3*a*, ends of the straight sidewall 106 are each provided with elongated hook-type strips 107*a*, 107*b* which are aligned to be joined with elongated loop-type strips 109*a*, 109*b*, shown in dotted fashion, along adjacent ends of the curved sidewalls 104, 108.

In order to convert the bassinet to a beside co-sleeper, the gussets 62–66 are removed by removing the brackets 58 and 60, brackets 58 and 60 being slidably joined to projections on the rods 46 and 48. The fabric member 100 is provided with elongated slits aligned with the projections on rods 46 and 48 for receiving the brackets 58, 60 and to enable the brackets 58 and 60 to be easily assembled or disassembled from the aforesaid cooperating projection.

Figure 1G:
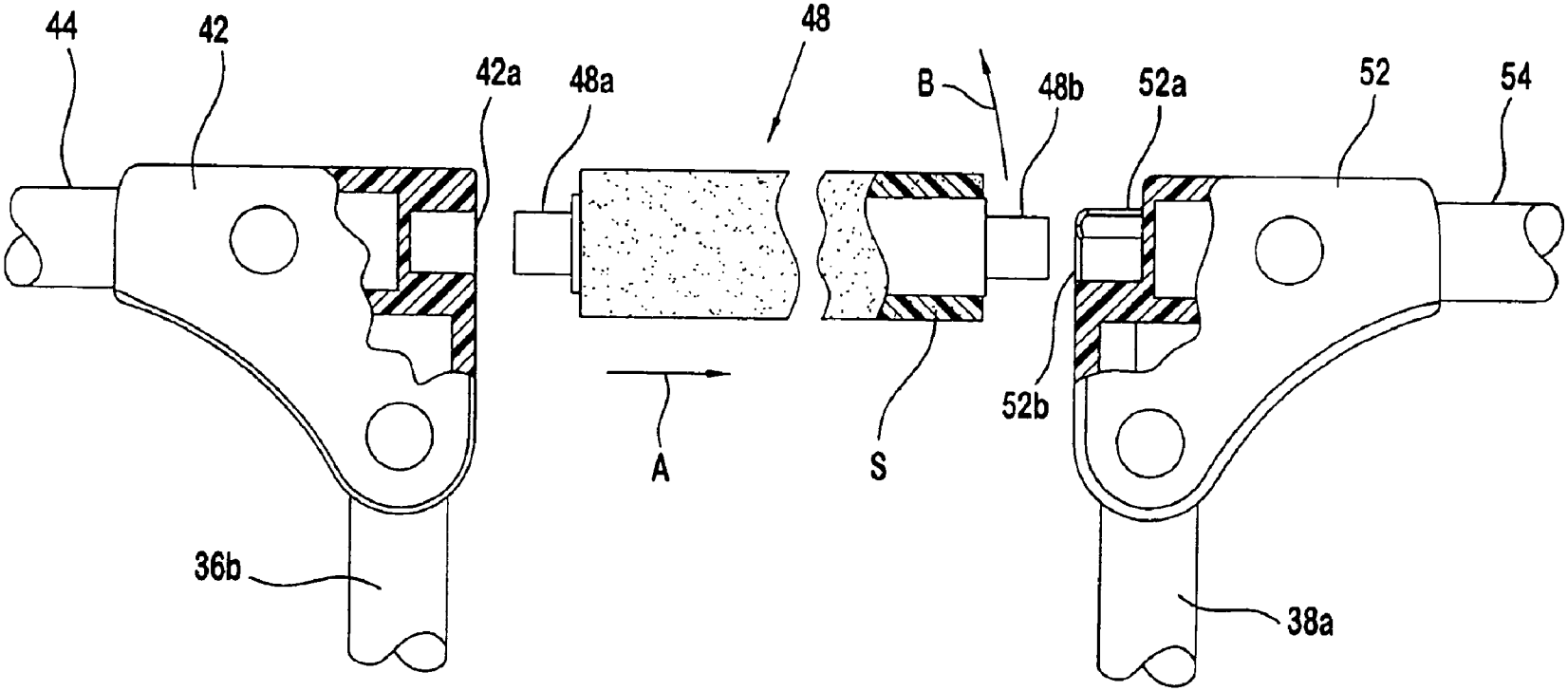

End 48*a* of rod 48 has a reduced diameter and is removably insertable into opening 42*a* in bracket 42, as shown in FIG. 1*g*. Opposite end 48*b* also has a reduced diameter and is longer than end 48*a*. End 48*b* is snap-fittingly received in the substantially U-shaped projection 52*a* at the end of bracket 52. In order to remove rod 48, after removal of bracket 60 and lifting of the skirt portion 108 (see FIG. 3*a*), end 48*b*is lifted upward in the direction of arrow B and out of the projection 52*a*. When end 48*b* is released from the reduced diameter portion 52*b* of projection 52*a*, rod 48 is moved in the direction of arrow A to remove end 48*a* from opening 42*a*.

Rod 48 is replaced by inserting end 48*a* into opening 42*a* and then lowering end 48*b* into projection 52*a* until end 48*b* moves below the reduced diameter portion 52*b*, causing end 48*b* to be snap-fitted into the projection 52*a*.

Rod 48 is removed by lifting end 48*b* upwardly and out of a locking recess in bracket 52, similar to the locking recess 24*h* on wheel assembly 24 (see FIG. 1*e*), and sliding rod 48 to the right out of the interior of bracket 42 until its left-hand end clears a receiving opening bracket 52, at which time the rod 48 may be removed. As a safety feature, rod 35 has both of its ends secured to arms 36*b*, 38*a*. The distance between rod 35 and board 56 is sufficiently small to prevent an infant's head from becoming wedged between rod 35 and board 56, while providing a barrier to prevent an infant from rolling out of the bassinet, even though rod 48 is removed.

Prior to removal of rod 48, the skirt portion 116 joined to straight sidewall 106 is lifted to gain access to rod 48.

After the brackets 58, 60 and rod 48 are removed, the ends of straight sidewall 106 are pulled away from adjacent curved sidewalls 104, 108 causing the cooperating button pairs to be moved apart to allow the straight sidewall 106 to be lowered and draped over rod 35, providing easier access to the interior of the sleeper while still providing a barrier (rod 35) to prevent an infant from rolling out ,of the beside co-sleeper. The thick, quilted sidewall 106, together with the resilient sleeves (see sleeve S in FIG. 1*f*), acts as a cushion to protect the infant from injury.

When the skirt portion 106 is pulled over the lower rod 35, the upper flounce portion 106*a* of skirt portion 106 is preferably aligned with the lower flounce position of the adjacent skirt portions, to enhance the aesthetic appearance even when the rod 48 is removed.

FIG. 3*b* shows the manner in which the co-sleeper may be retained against one side of an adult bed B. An elongated pair of straps 130, 131 each have loops 130*a*, 131*a*, provided at their free ends. The legs 12*a*–12*b* are preferably respectively passed through loops 130*a*, 131*a* when the skeletal structure is initially assembled. The straps 130, 131 are joined to a strap, 133, which is preferably passed between the mattress 134 and box spring 135 (or between the mattress 135 and bed frame 137). A flat, rectangular-shaped anchoring member 136 having slot through which the strap 133 is threaded 134, when aligned vertically, bridges across the region between and presses against the mattress and box spring 135 and rests against portions of the mattress and box spring. An adjustable, slidable locking member 136*a* allows the strap 133 to be tightened, holding the beside sleeper in place against the left-handed side of the bed and holds the anchoring member in place against the right-hand side of the bed. It should be understood that the casters should be in the down position with the casters locked to prevent rolling.

The loops 130*a*, 131*a* of straps 130, 131 shown in FIG. 3*b* may be released from the strap by conventional clip assemblies 138, 140, to allow the unit to be moved away from the adult bed without disturbing the straps 130, 131 and 133 and the anchoring member 136.

The sidewall 106 may be placed either over rod 35 or rod 48 when employed as a changing table. The height of the changing table may be raised or lowered to assure a comfortable height for use as a changing table.

The gussets 62–66 are covered with hood H, which is formed of an aesthetically pleasing fabric, to shade the infant's eyes from bright light and having elongated passageways (not shown) for receiving and concealing the gussets.

The convertible apparatus may be easily and quickly assembled and disassembled. When disassembled, the apparatus fits into a compact space and is easily transported due to the light-weight and yet rugged materials which are preferably either aluminum or rugged plastic or a combination thereof.

What is claimed is:

1. A combination bassinet, changing table and bedside sleeper structure comprising:

a board for supporting a mattress;

a substantially oval-shaped tubular rail;

a support for said board;

rail supports secured to and extending upwardly from said board for supporting said rail a spaced distance above said board;

said rail having a removable rod along one substantially straight side; and a fabric member draped over said rail.

2. The combination structure of claim 1 further comprising:

a fixed member along said one substantially straight side of said rail and supported above said board and below said rail to provide a barrier at said one side to prevent an infant resting on said board from rolling off of said board when the removable rod has been removed.

3. The combination structure of claim 2 wherein said fixed member is mounted upon a selected pair of said rail supports.

4. The combination structure of claim 3 wherein said removable rod is mounted upon the selected pair of rail supports a spaced distance above said fixed member.

5. The combination structure of claim 2 wherein said support is adjustable to adjust a height of said board relative to a top of an adult bed.

6. The combination structure of claim 5 further comprising a device for releaseably attaching the support to the adult bed.

7. The combination structure of claim 1 wherein said support is adjustable to adjust a height of the board to facilitate use of the structure as a changing table.

8. The combination structure of claim 1 further comprising a fabric storage basket mounted upon said support and beneath said board.

9. The combination structure of claim 8 wherein said basket is formed of an open weave mesh fabric.

10. The combination structure of claim 1 further comprising a hood removably mounted upon said rail.

11. The combination structure of claim 1 wherein at least said removable rod is substantially covered with a resilient cushioning sleeve.

12. The combination structure of claim 1 wherein said board is mounted upon said support.

13. The combination structure of claim 1 wherein said rail supports are mounted upon said support.

14. The combination structure of claim 1 wherein said rail supports are mounted upon an upper end of said support.

15. The combination structure of claim 1 wherein said rail supports and said board are mounted upon an upper end of said support.

16. The combination structure of claim 1 wherein said rail supports further comprise a mounting portion positioned between said board and an upper end of said support.

17. The combination structure of claim 1 further comprising common fasteners for securing said board and said rail supports to said support.

18. A combination bassinet, changing table and bedside sleeper structure comprising:

a board for supporting a mattress;

a tubular frame surrounding said board and having an upper cover-supporting portion and a frame supporting portion, said upper cover-supporting portion maintained above said board by said frame supporting portion;

a cover draped over said frame and resting on said cover supporting portion;

a second support for said frame and said board, said second support joined to said board and having adjustable legs for adjusting a height of said board and said frame; and said frame having means enabling use of said structure as a bedside sleeper when in a first position and enabling use as a bassinet when in a second position.

19. The combination structure of claim 18 further comprising coupling means for releaseably coupling the structure to an adult bed.

20. The combination structure of claim 18 wherein at least said upper cover supporting portion is covered with a resilient cushioning member.

* * * * *